United States Patent [19]

Lemos

[11] B 4,013,206

[45] Mar. 22, 1977

[54] ADJUSTABLE OUTWARD CLINCH ANVIL ASSEMBLY

[75] Inventor: Walter G. Lemos, East Providence, R.I.

[73] Assignee: Textron, Inc., Providence, R.I.

[22] Filed: Jan. 13, 1975

[21] Appl. No.: 540,703

[44] Published under the second Trial Voluntary Protest Program on April 13, 1976 as document No. B 540,703.

[52] U.S. Cl. ..... 227/83; 227/123

[51] Int. Cl.[2] ..... B27F 7/16

[58] Field of Search ..... 227/83, 108, 123; 269/235

[56] References Cited

UNITED STATES PATENTS

| | | | |
|---|---|---|---|
| 1,309,613 | 7/1919 | Dearsley | 269/235 |
| 3,152,335 | 10/1964 | Wandel et al. | 227/83 |
| 3,417,908 | 12/1968 | Treatman | 227/83 |

*Primary Examiner*—Granville Y. Custer, Jr.

*Attorney, Agent, or Firm*—Cushman, Darby & Cushman

[57] ABSTRACT

A stapling device having an outwardly clinching anvil member of spring metal mounted on a detachably fixed nose piece element by an adjusting mechanism comprising a stud extending outwardly from the nose piece element through an exterior keyway therein within which the anvil member is slidably mounted, the anvil member having a cam follower opening therein engageable by an eccentric cam of an adjusting member rotatably mounted on the stud, the adjusting member extending through a backing plate and including a knob portion engaging the same by which the adjusting member is rotationally moved to effect movement of the anvil member in the keyway parallel with the drive track. The backing plate includes an inwardly bent end engaged within the keyway to prevent turning thereof and a locking nut is provided to lock the adjusting mechanism after adjustment.

10 Claims, 3 Drawing Figures

ADJUSTABLE OUTWARD CLINCH ANVIL ASSEMBLY

This invention relates to stapling devices and more particularly to stapling devices of the type having outwardly clinching anvil assemblies.

Outwardly clinching anvil assemblies of the type herein contemplated are known in the art. These assemblies are normally utilized in stapling devices for driving staples into workpieces such as corrugated material utilized in containers where it is not practical or impossible to utilize a back-up anvil beneath or behind the workpiece to cause the legs of the staple to deflect in the manner normally employed in a conventional desk stapler or the like. Examples of outward clinching assemblies of this type are disclosed in the following U.S. Pat. Nos. 2,237,438; 3,152,335; 3,182,878; 3,291,357; and 3,807,619.

A common characteristic of all of these prior art outward clinching anvil assemblies is the provision of a pair of outwardly diverging leg deflecting surfaces on an anvil member which is normally disposed within the outer end of the drive track. The anvil member also includes a cam surface which is adapted to be engaged during the drive stroke of the staple driving element for the purpose of moving the anvil member outwardly of the drive track to permit the crown of the staple to pass thereby during the final driving movement of the staple. In order to permit this movement of the anvil member out of the drive track, the anvil member may be formed of spring metal or may be of rigid material pivotally mounted and spring biased. One of the problems encountered in assemblies of this type is that the position of the outward diverging surfaces of the anvil member within the drive track must be quite accurately determined since slight deviations in the position required will effect differences in the deflection of the legs during the driving movement. It has been found that significant variations can occur within normal manufacturing tolerances.

Accordingly, it is an object of the present invention to provide a means for effectively securing the anvil member in any desired position of adjustment to thereby obviate the problems noted above.

In accordance with the principles of the present invention, this objective is obtained by providing a keyway in the exterior surface of the nose piece element which is detachably fixedly secured as a part of the housing and providing a stud in the nose piece element which extends outwardly through the keyway and providing an adjusting mechanism mounted on the stud for fixedly adjusting the anvil member within the keyway. Preferably, the adjusting mechanism consists essentially of an adjusting member rotatably mounted on the stud having a cam portion thereon which engages within the cam follower opening formed in the anvil member. The adjusting member also includes an intermediate portion which engages within an opening in a plate mounted in backing relation to the anvil member. The adjusting member also includes a knob portion which engages the plate having a knurled exterior periphery for manual angular displacement which angular displacement effects a corresponding movement of the anvil member within the keyway. The entire assembly is locked into position by a locking nut threadedly engaged on the stud. The plate includes an upper end portion which is bent over the upper extremity of the anvil member into engagement with the keyway throughout the width thereof and a lower curved end surface extending across the entire width of the anvil member for insuring even flexure thereof.

Another object of the present invention is the provision of an outwardly clinching anvil assembly of the type described having an improved adjusting mechanism which is simple in construction, economical to manufacture, and effective in operation.

These and other objects of the present invention will become more apparent during the course of the following detailed description and appended claims.

The invention may best be understood with reference to the accompanying drawings wherein an illustrative embodiment is shown.

Figure 1:
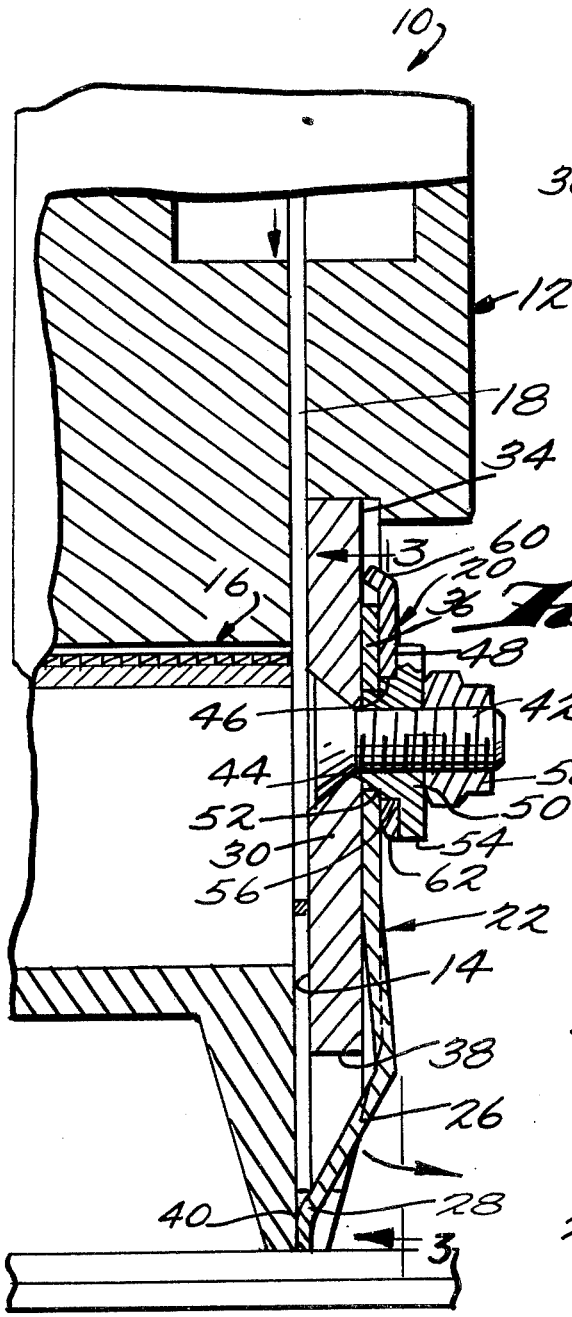
FIG. 1 is a fragmentary vertical sectional view of a stapling device embodying the principles of the present invention.

Referring now more particularly to the drawings, there is shown in FIG. 1 thereof a fragmentary view of a staple driving device, generally indicated at 10, embodying the principles of the present invention, which includes a rigid housing structure, generally indicated at 12, defining a vertically extending drive track, generally indicated at 14, a magazine structure 16 for receiving a supply of staples in conventional stick formation and feeding successive leading staples laterally into the drive track 14, and a fastener driving element 18 slidably mounted in the drive track 14 for downward vertical movement through a drive stroke to drive a leading staple outwardly of the drive track into a workpiece and an upward return stroke. The device 10 also includes an anvil assembly, generally indicated at 20, which serves to deflect the legs of the staple being driven into an outwardly diverging relation as it enters the workpiece.

For present purposes it will be understood that the magazine structure 16 may be of any known type capable of being loaded in any known manner and that any known means may be utilized to move the staple driving element 18 through a drive stroke-return stroke cycle.

The present invention is particularly concerned with the construction of the anvil assembly 20 and the improved adjustment capabilities embodied therein. The anvil assembly 20 is generally of a known type which includes a spring metal anvil member, generally indicated at 22, having a pair of downwardly and outwardly diverging staple leg deflecting surfaces 24 formed on a lower free end portion 26 thereof which diverging surfaces cooperate with similarly divergent surfaces 28 formed in the side walls defining the lower end of the drive track 14.

The drive track side wall surfaces 28 are formed within a separate nose piece element 30 constituting a part of the housing structure 12 which is detachably fixedly secured in operative position, as by bolts 32. Formed in the central exterior surface of the nose piece element 30 is a keyway 34 which extends in parallel relation with the drive track. The anvil member 22 includes a fixed end portion 36 which is slidably mounted within the keyway 34. It will be noted that the free end portion of the anvil member 22 extends downwardly and inwardly from the fixed end portion thereof through a cut out portion 38 of the nose piece element 30 so that the surfaces 24 are normally disposed within the drive track 14. The free end portion 26 of the anvil member 22 includes an inner cam surface 40 (see FIG. 1) which is normally disposed in a position to be engaged by the crown of a staple during the last part of the driving movement thereof. This engagement serves to move the free end portion 26 of the anvil member 22 outwardly of The drive track 14 permitting the crown of the staple to leave the drive track and be moved into engagement with the workpiece at the end of the drive stroke of the staple driving element 18.

Figure 3:
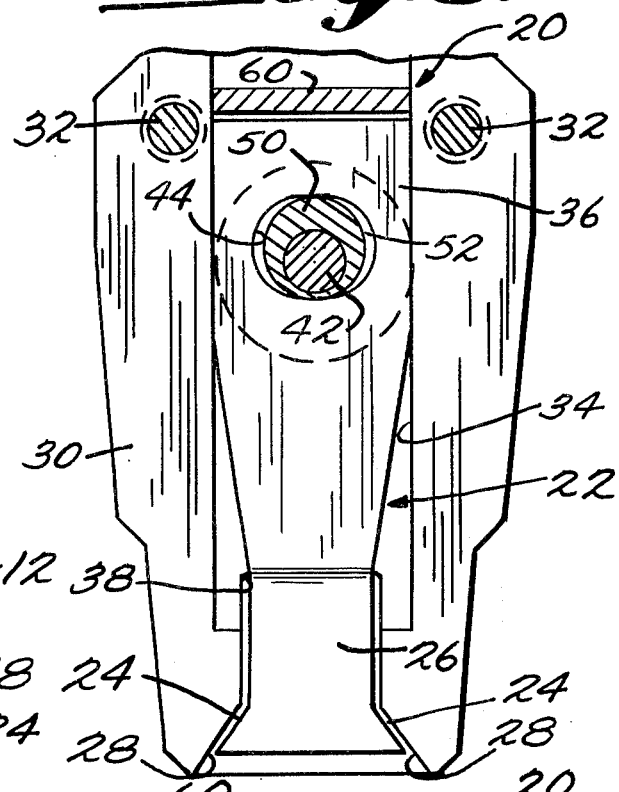
FIG. 3 is a sectional view taken along the line 3—3 of FIG. 1.
Figure 2:
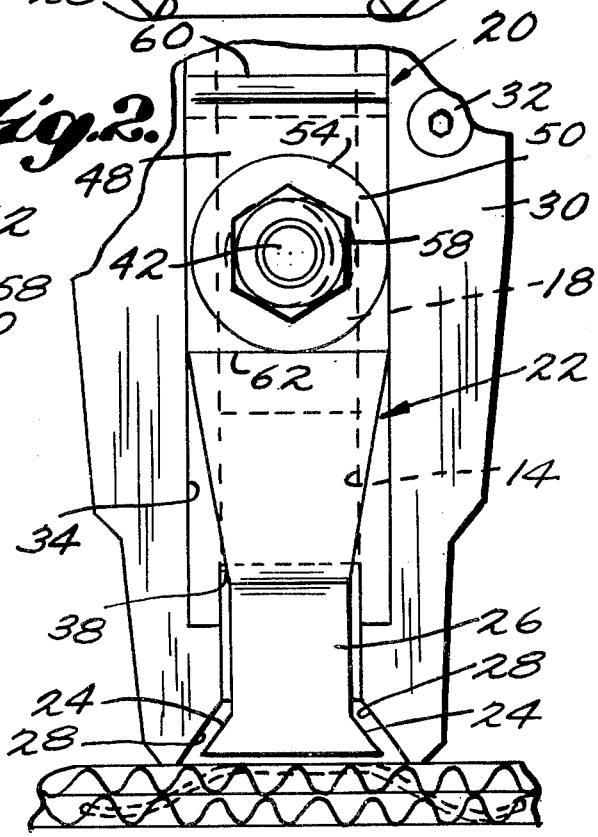
FIG. 2 is a fragmentary front elevational view of the outward clinch anvil assembly of the device shown in FIG. 1.

Extending within the nose piece element 30 outwardly through the keyway 34 thereof is a threaded stud 42. As best shown in FIG. 3, the fixed end portion 36 of the anvil member 22 includes a transversely elongated cam follower opening 44 formed therein through which the stud 42 extends. The stud 42 also extends through a concentric cylindrical opening 46 formed within a generally rectangular plate 48 disposed in backing relation to the fixed end portion 36 of the anvil member 22.

Rotatably mounted on the stud 42 is an adjusting member 50 which includes an inner cam portion formed with an eccentric cylindrical periphery 52, an enlarged outer knob portion formed with a knurled annular periphery 54 and an intermediate portion formed with a concentric cylindrical periphery 56. It will be noted that the sum of the axial dimensions of the inner cam portion and intermediate portions of the adjusting member is less than the sum of the thicknesses of the anvil member and plate thereby permitting the tightening of a nut 58 on the outer end of the stud 42 to effect a fixed securement of the anvil member 22 with the keyway 34 by tightening the outer knob portion 54 onto the plate 48. The plate includes an inwardly bent upper end portion 60 which extends over the upper extremity of the anvil member 22 into the keyway 34 throughout the width thereof. This engagement prevents the plate from turning about the axis of the stud 42 during an adjusting operation. The opposite end of the plate 48 includes an outwardly curved surface 62 extending along the entire width of the anvil member 22 to provide for the even flexure thereof during operation.

With reference to FIG. 1 of the drawing, it will be noted that the entire anvil assembly 20 is carried by the nose piece element 30 which is detachably fixedly secured to the housing structure 12 by bolts 32. With this arrangement, the present subject matter is susceptible to incorporation within known stapling devices by the simple expedient of replacing the conventional nose piece element of such devices with the element 30 carrying the adjustable anvil assembly 20.

It will also be noted that it is not essential that strict tolerances be maintained in securing the anvil member 22 to the nose piece element 30 as is the case with known assemblies which do not provide for adjustment. With the present assembly the only tolerances which must be maintained are with respect to the angle of the surfaces 24 with respect to the longitudinal extent of the anvil member. Likewise, the surfaces 28 must be accurately related with respect to the keyway 34. So long as these relationships are maintained, which are easily within machine tolerances, the present assembly provides for the accurate maintenance of the desired amount of outward clinch of the staple legs during operation. Moreover, with the present arrangement, the operator is provided with means by which the degree of outward clinch can be changed to suit different types of workpieces. The adjustment is effected simply by loosening the locking nut 58 and manually grasping the knurled periphery 54 of the adjusting member 50. The manual angular or rotational movement of the adjusting member will effect a corresponding longitudinal movement of the anvil member within the keyway 34. This movement serves to space the staple leg deflecting surfaces 24 of the anvil member from the surfaces 28 into any desired position so as to achieve the desired outward clinching movement of the legs necessary for the particular workpiece involved. When the desired position is obtained, it is necessary merely to tighten the locking nut 58 to maintain the parts in their desired adjusted position. It will be noted that the turning movement of the adjusting member 50 will not result in a turning movement of the backing plate 48 since the latter is prevented from such movement by virtue of the engagement of the bent end portion 60 within the keyway 34. This action serves to maintain the flexure surface 62 of the backing plate in proper operative position at all times.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A stapling device comprising a housing defining a drive track, a staple magazine for receiving a supply of staples in stick formation and feeding successive leading staples laterally into the drive track, a staple driving element slidably mounted in said drive track through a drive stroke to drive a leading staple within said drive track outwardly thereof into a workpiece and a return stroke, the outer end of said drive track being defined by outwardly diverging side wall surfaces, said housing including a keyway formed in the exterior thereof parallel with said drive track, a spring metal anvil member having a fixed end portion slidably mounted within said keyway, said anvil member including a free end portion normally extending within the outward end of said drive track, the free end portion of said anvil member having a pair of outwardly diverging side wall surfaces cooperating with said diverging drive track side wall surfaces for deflecting the legs of a staple outwardly during the driving movement thereof and a cam surface engageable during the last portion of the staple driving element drive stroke to cam said free end portion outwardly of said drive track and enable the staple crown to move thereby during the last part of the driving movement of the staple, and means for fixedly securing the fixed end portion of said anvil member in any one of a multiplicity of adjusted positions within said keyway comprising:

a threaded stud extending from said housing outwardly through said keyway, the fixed end portion of said anvil member having a cam follower opening formed therein through which said stud extends, a generally rectangular plate having an opening therein through which said stud extends, said plate being disposed in backing relation to the fixed end portion of said anvil member and including an inwardly bent end portion extending beyond said anvil member within said keyway throughout the width thereof and an opposite end portion extending throughout the width of said anvil member providing a flexure surface therefor, an adjusting member rotatably mounted on said stud, said adjusting member including an inner cam portion disposed within the cam follower opening of said anvil member of a shape relative thereto such as to effect a displacement of said anvil member along said keyway in response to the rotational displacement of said adjusting member, an outer knob portion for manually effecting rotational displacement of said adjusting member, and an intermediate portion disposed within the opening in said plate, and a locking nut threadedly engaged on the outer end of said stud for maintaining said adjusting member in any position of rotational displacement and said anvil member in a fixed position within said keyway corresponding thereto.

2. A stapling device as defined in claim 1 wherein the opening in said plate is cylindrical with its axis coincident with the axis of said stud and the intermediate portion of said adjusting member is of corresponding cylindrical shape.

3. A stapling device as defined in claim 2 wherein the cam portion of said adjusting member is cylindrical with its axis offset from the axis of said stud.

4. A stapling device as defined in claim 3 wherein the knob portion of said adjusting member includes a knurled exterior periphery of a size greater than said intermediate portion.

5. A stapling device as defined in claim 4 wherein the sum of the axial dimensions of said cam portion and said intermediate portion is less than the sum of the thicknesses of said anvil member and said plate.

6. A stapling device as defined in claim 1 wherein the cam portion of said adjusting member is cylindrical with its axis offset from the axis of said stud.

7. A stapling device as defined in claim 6 wherein the knob portion of said adjusting member includes a knurled exterior periphery of a size greater than said intermediate portion.

8. A stapling device as defined in claim 1 wherein said stud is carried by a separate nose piece element constituting a detachably fixedly secured part of said housing.

9. A stapling device as defined in claim 1 wherein the knob portion of said adjusting member includes a knurled exterior periphery of a size greater than said intermediate portion.

10. A stapling device as defined in claim 9 wherein the sum of the axial dimensions of said cam portion and said intermediate portion is less than the sum of the thicknesses of said anvil member and said plate.

* * * * *